US009446505B2

(12) United States Patent
Huang

(10) Patent No.: US 9,446,505 B2
(45) Date of Patent: Sep. 20, 2016

(54) STRAP WRENCH

(71) Applicant: POUL CHANG METAL INDUSTRY CO.,LTD., Taichung (TW)

(72) Inventor: Chia-Hao Huang, Taichung (TW)

(73) Assignee: POUL CHANG METAL INDUSTRY CO., LTD., Taichung (TW)

( * ) Notice: Subject to any disclaimer, the term of this patent is extended or adjusted under 35 U.S.C. 154(b) by 246 days.

(21) Appl. No.: 14/248,359

(22) Filed: Apr. 9, 2014

(65) Prior Publication Data

US 2015/0290781 A1 Oct. 15, 2015

(51) Int. Cl.

| | |
|---|---|
| ***B25B 13/52*** | (2006.01) |
| ***B25B 23/00*** | (2006.01) |
| ***B25G 1/00*** | (2006.01) |
| ***B25B 13/46*** | (2006.01) |
| ***B25B 27/00*** | (2006.01) |

(52) U.S. Cl.

CPC ..... *B25B 13/52* (2013.01); *B25B 13/46* (2013.01); *B25B 27/0042* (2013.01); *B25G 1/005* (2013.01)

(58) Field of Classification Search

CPC ..... B25B 13/52; B25B 27/0042; B25B 23/0007; B67B 7/186; B25G 1/005

USPC ..... 81/64, 3.43

See application file for complete search history.

(56) References Cited

U.S. PATENT DOCUMENTS

| | | | | |
|---|---|---|---|---|
| 20,711 | A * | 6/1858 | Hopkins | B44B 3/065 269/131 |
| 4,150,591 | A * | 4/1979 | Ackeret | B67B 7/186 24/20 LS |
| 4,532,833 | A * | 8/1985 | Downs | B25B 13/52 294/31.2 |
| 4,950,015 | A * | 8/1990 | Nejib | A61M 5/3213 128/919 |
| 7,155,999 | B1 * | 1/2007 | Helfet | B25B 13/52 81/3.4 |
| 8,316,740 | B2 * | 11/2012 | Idir | B25B 13/52 81/3.43 |
| 9,205,540 | B2 * | 12/2015 | Lin | B25B 13/52 |

* cited by examiner

*Primary Examiner* — Hadi Shakeri

(57) ABSTRACT

A strap wrench is used to drive a cylindrical object and contains: a handle including two recesses and a longitudinal slot; a strap including a first end portion and a second end portion which are inserted into the two recesses; a guiding rod longitudinally inserted into the handle; a supporting block rotatably connected with a first segment and located inside the strap; a movable member disposed on the guiding rod and moving between a first position and a second position, the movable member joining with the strap; a push switch slidably fixed in the longitudinal slot and rotatably connected with the movable member; and a spring for pushing the movable member to move toward the second position. Thereby, the movable member is driven by the engaging block to move between the first position and the second position so as to operate the strap wrench easily.

18 Claims, 8 Drawing Sheets

STRAP WRENCH

FIELD OF THE INVENTION

The present invention relates to a wrench, and more particularly to a strap wrench which is used to rotate a cylindrical object of an oil filter of a motorcycle or a vehicle.

BACKGROUND OF THE INVENTION

A conventional strap pipe wrench is disclosed in PCT Patent No. WO2009/004201 and contains a handle, a strap, a connecting mechanism moving relative to the handle, and a movable member for moving the connecting mechanism. The handle includes a support block for driving a cylindrical object to move, and wherein the connecting mechanism moves between a first position and a second position. The strap is released at the first position, and the strap is tighten at the second position. The movable member includes a locking element for fixing the connecting mechanism at the first position relative to the handle. The strap pipe wrench further contains a driving mechanism for pushing the connecting mechanism to move toward the second position and a controlling mechanism for releasing the locking element.

However, a structure of the connecting mechanism is complicated and is produced at a high cost. Furthermore, the conventional strap pipe wrench is fixed by the controlling mechanism, and the connecting mechanism is positioned at the first position by ways of the locking element, thereafter the handle is grasped by one hand, and the strap is held and is manually operated by the other hand to adjust a length of the strap for corresponding to a diameter of the cylindrical object, thus operating the conventional strap pipe wrench troublesomely.

The present invention has arisen to mitigate and/or obviate the afore-described disadvantages.

SUMMARY OF THE INVENTION

The primary objective of the present invention is to provide a strap wrench in which a press switch is operated by user's one hand to engage with or disengage from a guiding rod, hence a movable member is driven by an engaging block to move between a first position and a second position, thus operating the strap wrench easily.

To obtain the above objectives, a strap wrench provided by the present invention contains: a handle, a strap, a guiding rod, a supporting block, a movable member, a push switch, and a spring.

The handle is hollow and includes two recesses and a longitudinal slot.

The strap is made of metal material and includes a first end portion and a second end portion which are inserted into the two recesses of the handle to wind a cylindrical object.

The guiding rod is longitudinally inserted into the handle.

The supporting block is rotatably connected with a first segment of the handle and is located inside the strap and is employed to support the cylindrical object.

The movable member is disposed on the guiding rod and moves between a first position and a second position, the movable member joins with the first end portion and the second end portion of the strap, wherein when the movable member is located at the first position, the strap is released loosely relative to the cylindrical object; and when the movable member is located at the second position, the strap is tighten relative to the cylindrical object.

The push switch is slidably fixed in the longitudinal slot and is rotatably connected with the movable member, wherein the push switch is engaged with or disengaged from the guiding rod so that the movable member moves between the first position and the second position.

The spring is used for pushing the movable member to move toward the second position.

Since the engaging block is engaged with or is disengaged from the guiding rod by pressing or releasing the press switch, and the movable member is driven by the engaging block to move, such that a length of the strap is adjusted so that the strap winds the cylindrical object based on a diameter of the cylindrical object.

DETAILED DESCRIPTION OF THE PREFERRED EMBODIMENTS

Figure 1:
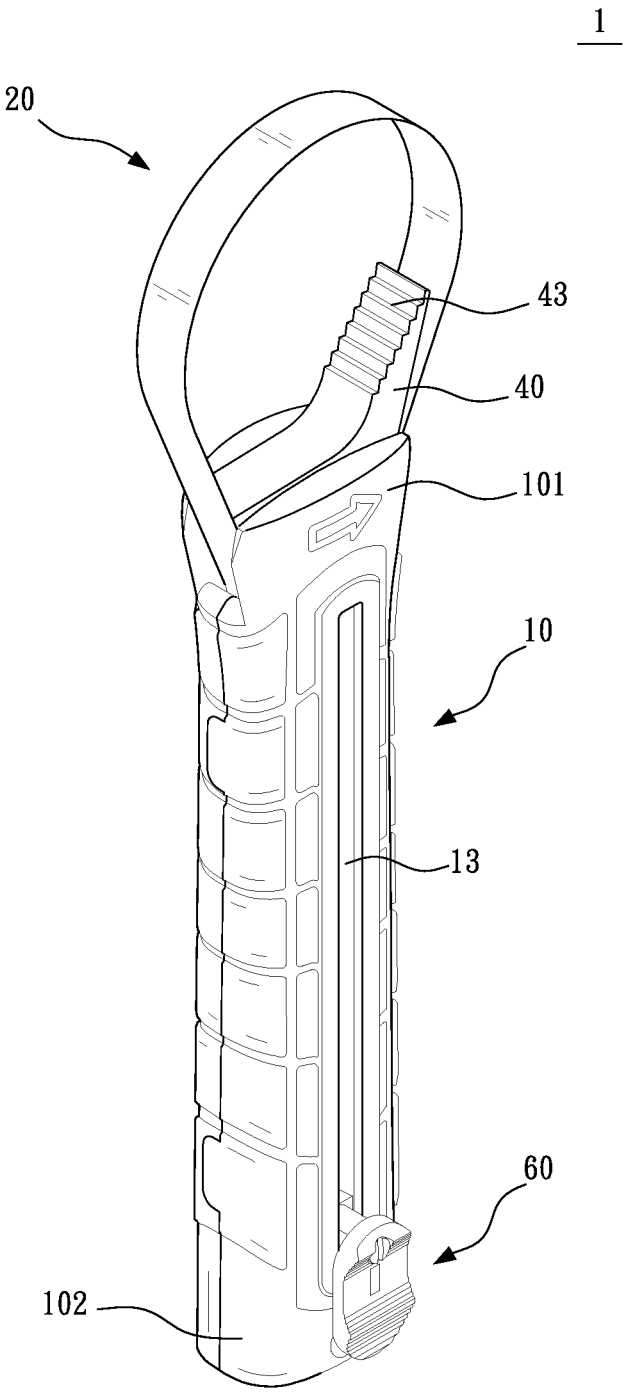
FIG. 1 is a perspective view showing the assembly of a strap wrench according to a preferred embodiment of the present invention.
Figure 2:
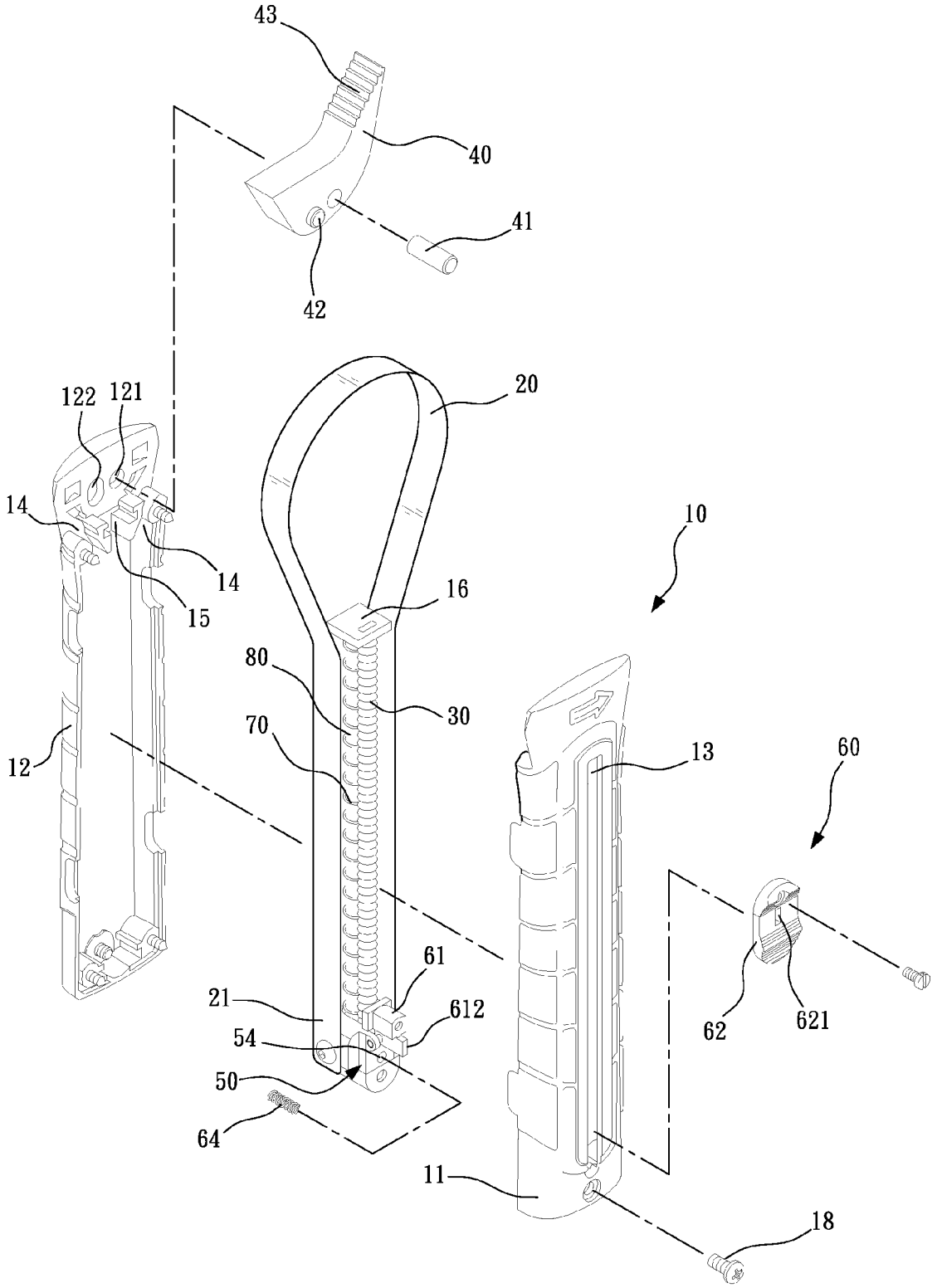
FIG. 2 is a perspective view showing the exploded components of the strap wrench according to the preferred embodiment of the present invention.
Figure 3:
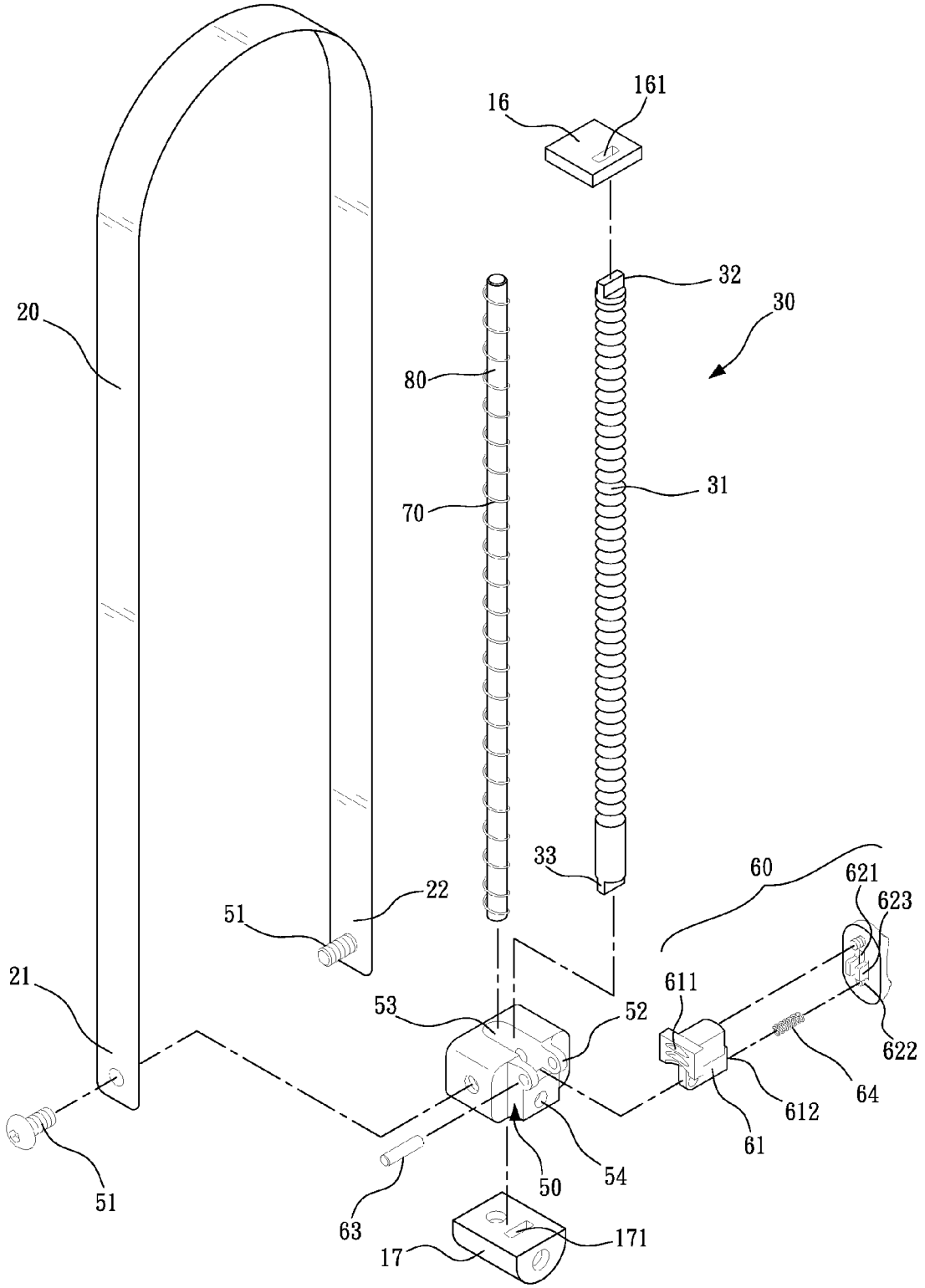
FIG. 3 is another perspective view showing the exploded components of the strap wrench according to the preferred embodiment of the present invention.

With reference to FIGS. 1-5, a strap wrench 1 according to a first embodiment of the present invention is used to drive a cylindrical object 100 of an oil filter of a motorcycle or a vehicle and comprises:

a handle 10 being hollow and including a first segment 101 and a second segment 102, the handle 10 also including a first housing 11 and a second housing 12 which are locked together, and the first housing 11 having a longitudinal slot 13 defined therein, the second housing 12 having two recesses 14 obliquely formed on one end of an inner wall thereof and corresponding to each other, wherein each recess 14 has a lower end, a width of which is decreased downwardly, and between the two recesses 14 is defined a retaining opening 15; wherein the second housing 12 has a circular trough 121 and an arcuate trough 122;

a strap 20 made of metal material and including a first end portion 21 and a second end portion 22 which are inserted into the two recesses 14 of the handle 10 to wind the cylindrical object 100;

a guiding rod 30 longitudinally inserted into the handle 10 and including a toothed section 31 arranged therearound and a first locking extension 32 and a second locking extension 33 which are located at two ends of the guiding rod 30;

a supporting block 40 rotatably connected with the first segment 101 of the handle 10 and located inside the strap 20; the supporting block 40 being coupled with the second housing 12 by inserting a first bolt 41 into the circular trough 121 through the supporting block 40 and inserting a second bolt 42 into the arcuate trough 122 via the supporting block 40, such that the supporting block 40 swings along the first bolt 41; the supporting block 40 including a plurality of support teeth 43 formed around a peripheral side thereof and employed to support the cylindrical object 100;

a movable member 50 disposed on the guiding rod 30 and moving between a first position and a second position, the movable member 50 joining with the first end portion 21 and the second end portion 22 of the strap 20 by ways of two first screws 51; the movable member 50 including two tabs 52 between which is defined a through groove 53 for inserting the guiding rod 30, and the member 50 also including a hole 54 proximate to the two tabs 52, the through groove 53 having a stopping fence 55 formed on an inner side thereof;

a push switch 60 slidably fixed in the longitudinal slot 13 and rotatably connected with the movable member 50, the push switch 60 is engaged with or disengaged from the guiding rod 30 so that the movable member 50 moves between the first position and the second position; the press switch 60 including an engaging block 61 coupled with the two tabs 52 by using a third bolt 63 and a pressing block 62 for driving the engaging block 61 to swing, the engaging block 61 having plural engagement teeth 611 defined on a bottom end thereof and engaging with the toothed section 31 of the guiding rod 30, and the engaging block 61 also having a noncircular protrusion 612 disposed on a top end thereof and retaining with a cutout 621 of the pressing block 62, wherein the engaging block 61 is coupled with the pressing block 62 by means of a second screw 65; and wherein the pressing block 62 includes a flange 622 formed on a bottom end thereof and fitted with a first end of a resilient element 64, and a second end of the resilient element 64 is accommodated in the hole 54 of the movable member 50, such that the engaging block 61 is engaged with the guiding rod 30; the pressing block 62 further has raised patterns arranged on a top end thereof to obtain an anti-slip effect; hence after the pressing block 62 is pressed, it drives the engaging block 61 to swing relative to the movable member 50 along the third bolt 63 so that the engaging block 61 is removed from the guiding rod 30, and the pressing block 62 drives the movable member 50 to move along the longitudinal slot 13.

Preferably, the flange 622 has two wings 623 arranged on one side thereof so that when the pressing block 62 is coupled with the engaging block 61, the two wings 623 are fitted on two sides of the noncircular protrusion 612, thereby connecting the pressing block 62 with the engaging block 61 more securely.

The strap wrench 1 further comprises a connecting member 16 retained in the retaining opening 15 of the second housing 12 and including an aperture 161 for inserting the first locking extension 32 of the guiding rod 30;

a fixing member 17 fixed between the first housing 11 and the second housing 12 and located adjacent to the second segment 102 of the handle 10, wherein the fixing member 17 is fixed between the first housing 11 and the second housing 12 by ways of a locking element 18, and the fixing member 17 has an orifice 171 for inserting the second locking extension 33 of the guiding rod 30, such that the guiding rod 30 is mounted between the connecting member 16 and the fixing member 17 without rotation;

a spring 70 including a first end abutting against the stopping fence 55 of the movable member 50 and a second end for pushing against the connecting member 16, such that the movable member 50 moves toward the second position, and the spring 70 is fitted on a circular column 80 parallel to the guiding rod 30, wherein the circular column 80 includes a first end disposed in the connecting member 16 and a second end secured in the fixing member 17 via the through groove 53. Preferably, each of the connecting member 16 and the fixing member 17 has a pore or a notch for fixing the first end and the second end of the circular column 80.

Figure 4:
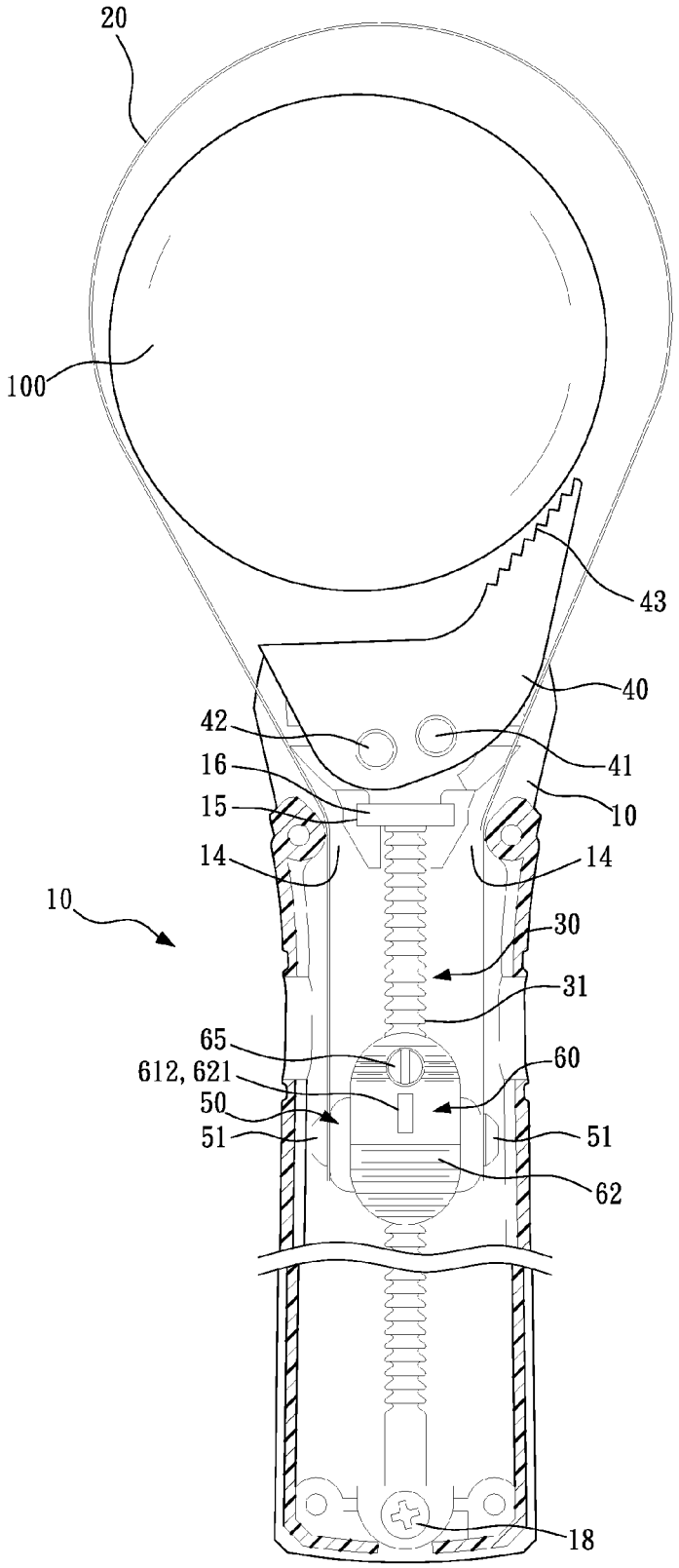
FIG. 4 is a cross sectional view showing the operation of the strap wrench according to the preferred embodiment of the present invention.
Figure 5:
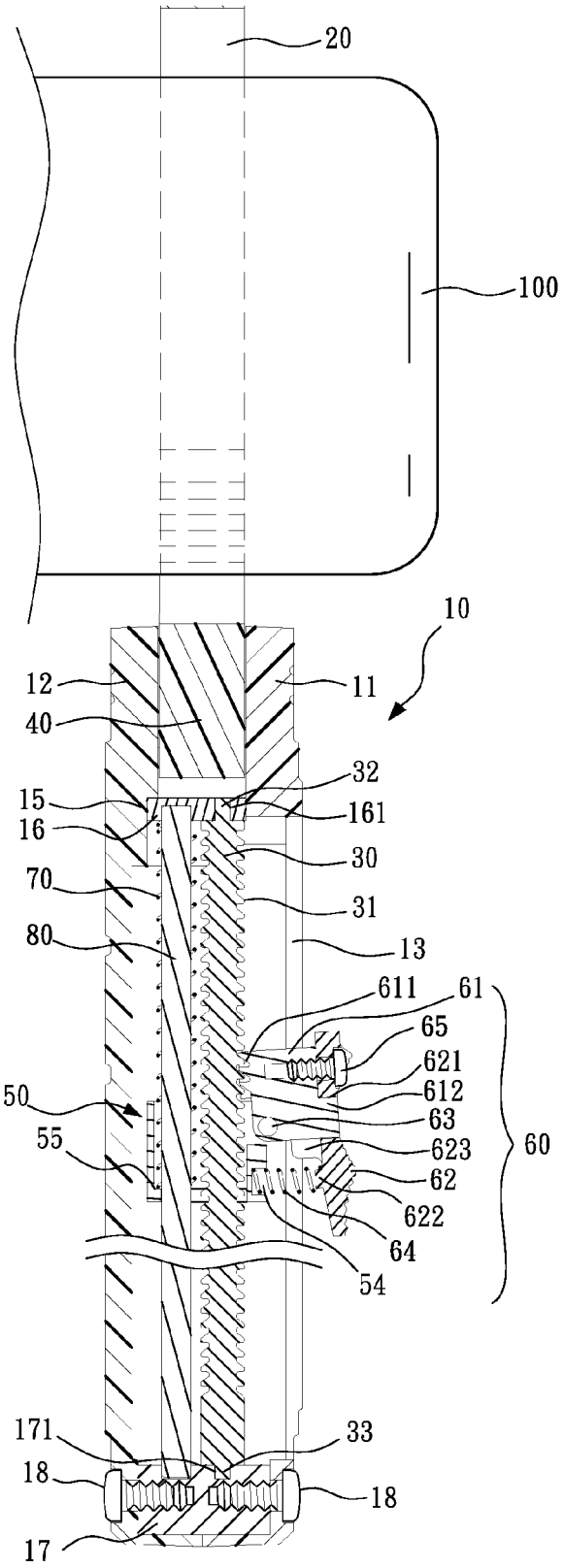
FIG. 5 is another cross sectional view showing the operation of the strap wrench according to the preferred embodiment of the present invention.

Referring to FIGS. 4 and 5, the movable member 50 is located at the first position so that the strap 20 winds the cylindrical object 100 loosely, wherein the plural engagement teeth 611 of the engaging block 61 engage with the toothed section 31 of the guiding rod 30, thus locking the guiding rod 30 with the press switch 60 fixedly.

Figure 6:
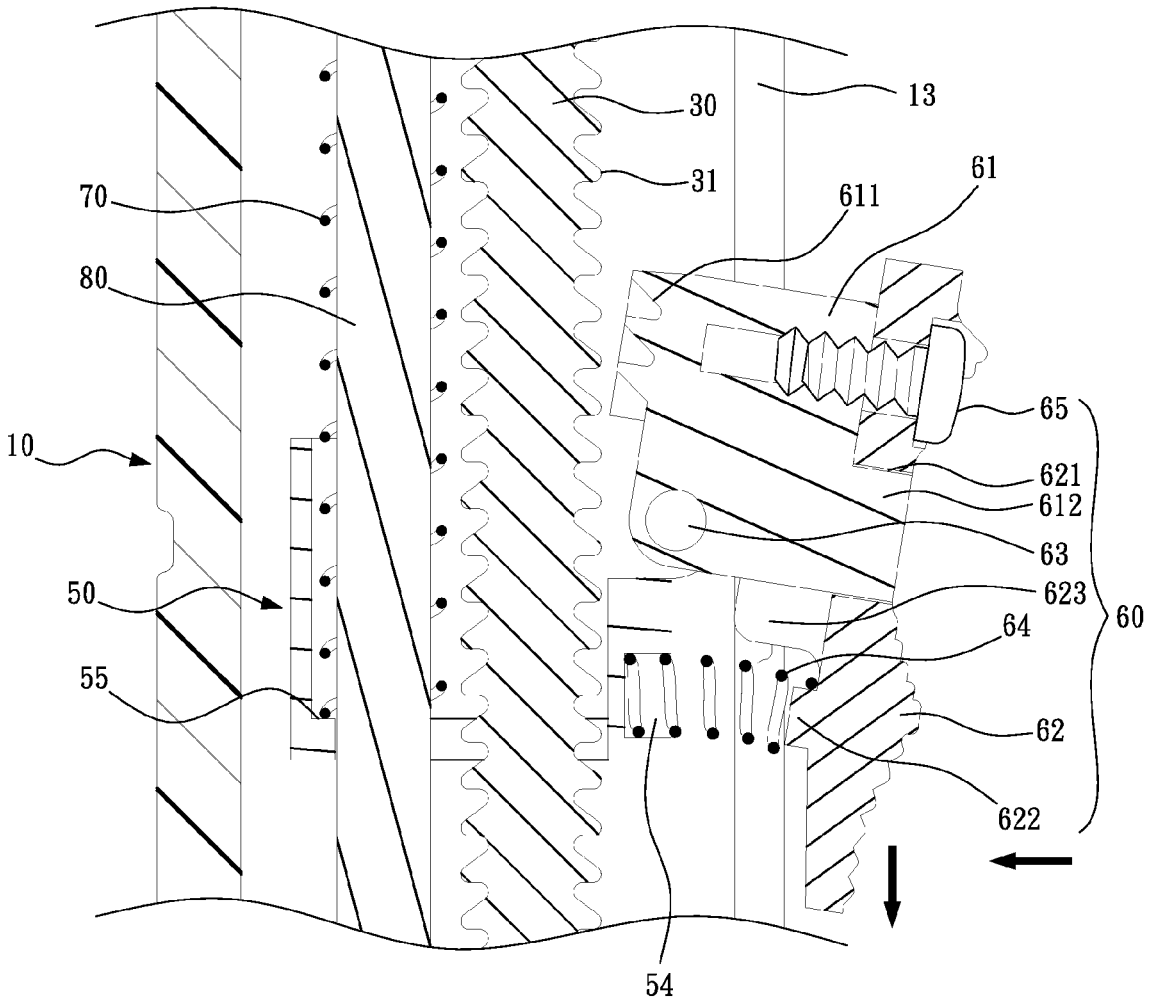
FIG. 6 is also another cross sectional view showing the operation of the strap wrench according to the preferred embodiment of the present invention
Figure 7:
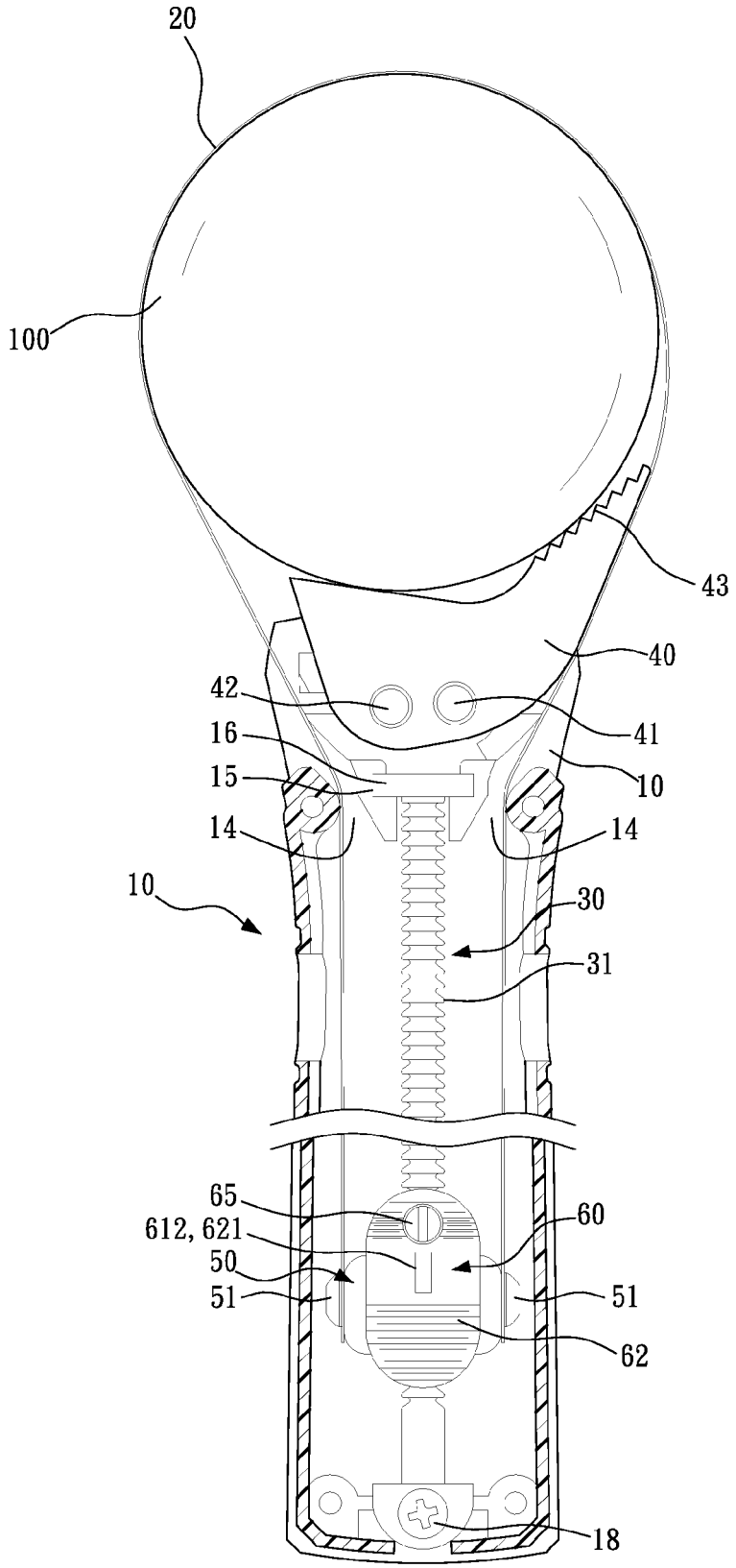
FIG. 7 is still another cross sectional view showing the operation of the strap wrench according to the preferred embodiment of the present invention.
Figure 8:
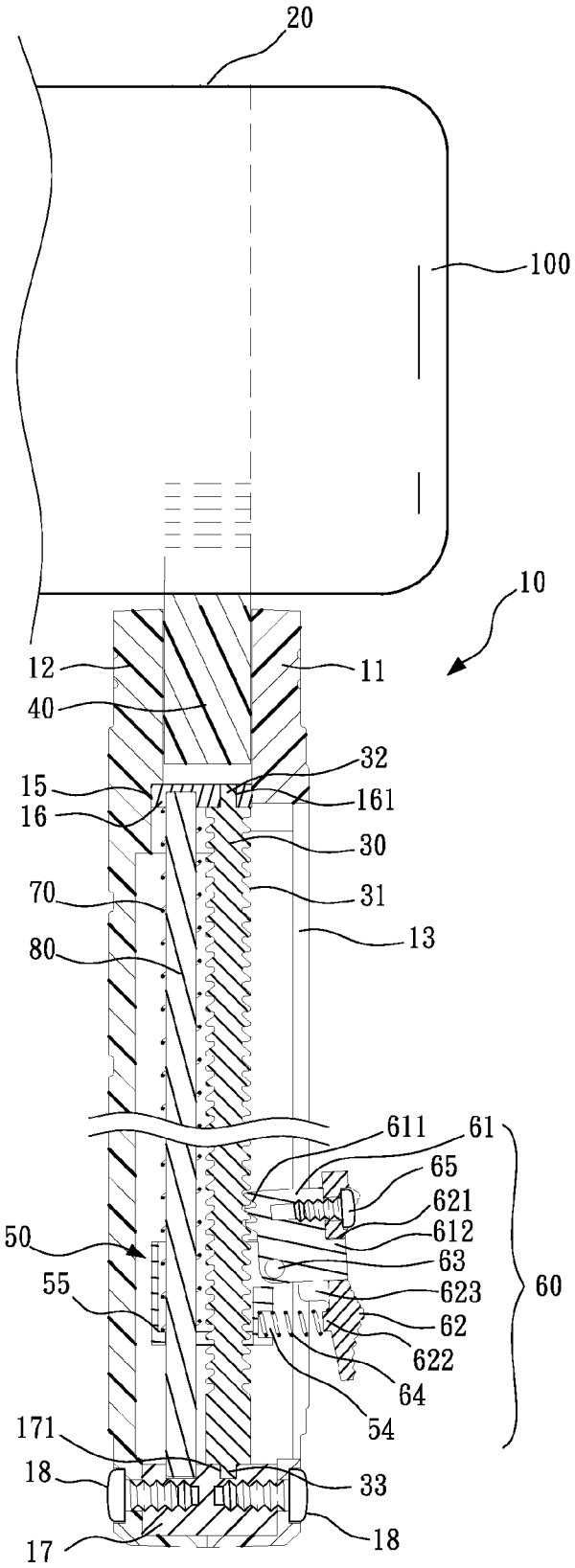
FIG. 8 is another cross sectional view showing the operation of the strap wrench according to the preferred embodiment of the present invention.

As shown in FIGS. 6 to 8, when a user holds the handle 10 and presses the pressing block 62 of the press switch 60, the engaging block 61 swings relative to the movable member 50, and the plural engagement teeth 611 of the engaging block 61 disengage from the toothed section 31 of the guiding rod 30, such that the press switch 60 is pressed downwardly to drive the movable member 50 to move upwardly along the guiding rod 30, thus moving the movable member 50 from the first position to the second position.

When the plural engagement teeth 611 disengage from the toothed section 31 of the guiding rod 30, the movable member 50 is not pushed by the spring 70 to move downwardly toward the second position, and the strap 20 moves downwardly with the movable member 50 to wind the cylindrical object 100 tightly, thereafter the user does not press the pressing block 62 so that the engaging block 61 is engaged with the guiding rod 30 once more (as illustrated in FIG. 8), hence the user swings the handle 10 to remove the cylindrical object 100 rotatably, thereby maintaining the oil filter of the motorcycle or the vehicle.

Since the engaging block 61 is engaged with or is disengaged from the guiding rod 30 by pressing or releasing the press switch 60, the movable member 50 is driven by the engaging block 61 to move, such that a length of the strap 20 is adjusted so that the strap 20 winds the cylindrical object 100 based on a diameter of the cylindrical object 100.

In addition, the press switch 60 is operated by user's one hand to engage with or disengage from the guiding rod 30, hence the movable member 50 is driven by the engaging block 61 to move between the first position and the second position, thus operating the strap wrench easily.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A strap wrench being used to drive a cylindrical object, the strap wrench comprising:

a handle being hollow and including at least two recesses and a longitudinal slot;

a strap made of a metal material and including a first end portion and a second end portion which are inserted into the two recesses of the handle to wind a cylindrical object;

a guiding rod longitudinally inserted into the handle;

a supporting block rotatably connected with a first segment of the handle and located inside the strap and employed to support the cylindrical object;

a movable member disposed on the guiding rod and moving between a first position and a second position, the movable member joining with the first end portion and the second end portion of the strap, wherein when the movable member is located at the first position, the strap is loosened relative to the cylindrical object, and when the movable member is located at the second position, the strap is tightened relative to the cylindrical object;

a push switch slidably fixed in the longitudinal slot and rotatably connected with the movable member, wherein the push switch is engaged with or disengaged from the guiding rod so that the movable member moves between the first position and the second position; and a spring for pushing the movable member to move toward the second position;

wherein the guiding rod includes a toothed section arranged therearound, and the press switch has plural engagement teeth engaging with the toothed section of the guiding rod, such that the movable member is located at the second position; and wherein the movable member includes two tabs, the press switch includes an engaging block coupled with the two tabs and includes a pressing block for driving the engaging block to swing, and the plural engagement teeth are defined on a bottom end of the engaging block.

2. The strap wrench as claimed in claim 1, wherein the handle also includes a first housing and a second housing which are locked together, and the two recesses are obliquely formed on one end of an inner wall of the second housing.

3. The strap wrench as claimed in claim 2, wherein the longitudinal slot is defined in the first housing and is served to slidably fix the push switch so that the push switch is rotatably connected with the movable member, and when the movable member is located at the second position, the press switch drives the movable member to move along the longitudinal slot.

4. The strap wrench as claimed in claim 2, wherein the second housing has a circular trough and an arcuate trough, the supporting block is coupled with the second housing by inserting a first bolt into the circular trough through the supporting block and by inserting a second bolt into the arcuate trough via the supporting block, such that the supporting block swings along the first bolt limitedly.

5. The strap wrench as claimed in claim 1, wherein the engaging block is coupled with the pressing block by means of a screw.

6. The strap wrench as claimed in claim 1 further comprising a resilient element defined between the pressing block and the movable member, such that the engaging block is engaged with the guiding rod.

7. The strap wrench as claimed in claim 6, wherein the pressing block includes a flange formed on a bottom end thereof and fitted with a first end of a resilient element, and a second end of the resilient element is accommodated in a hole of the movable member.

8. The strap wrench as claimed in claim 1, wherein the engaging block also has a noncircular protrusion disposed on a top end thereof and retaining with a cutout of the pressing block.

9. The strap wrench as claimed in claim 8, wherein the pressing block has two wings arranged on the bottom end thereof so that when the pressing block is coupled with the engaging block, the two wings are fitted on two sides of the noncircular protrusion.

10. A strap wrench being used to drive a cylindrical object and comprising:

a handle being hollow and including at least two recesses, a longitudinal slot, and a first housing and a second housing which are locked together, the two recesses being obliquely formed on one end of an inner wall of the second housing;

a strap made of metal material and including a first end portion and a second end portion which are inserted into the two recesses of the handle to wind a cylindrical object;

a guiding rod longitudinally inserted into the handle;

a supporting block rotatably connected with a first segment of the handle and located inside the strap and employed to support the cylindrical object;

a movable member disposed on the guiding rod and moving between a first position and a second position, the movable member joining with the first end portion and the second end portion of the strap, wherein when the movable member is located at the first position, the strap is loosened relative to the cylindrical object, and when the movable member is located at the second position, the strap is tightened relative to the cylindrical object;

a push switch slidably fixed in the longitudinal slot and rotatably connected with the movable member, wherein the push switch is engaged with or disengaged from the guiding rod so that the movable member moves between the first position and the second position;

a spring for pushing the movable member to move toward the second position; and a fixing member fixed between the first housing and the second housing for inserting the guiding rod;

wherein between the two recesses is defined a retaining opening for retaining a connecting member, and the guiding rod is coupled with the connecting member; and wherein the guiding rod includes a first locking extension and a second locking extension which are located at two ends of the guiding rod, the connecting member includes an aperture for inserting the first locking extension of the guiding rod, and the fixing member has an orifice for inserting the second locking extension of the guiding rod, such that the guiding rod is mounted between the connecting member and the fixing member without rotation.

11. The strap wrench as claimed in claim 10, wherein the longitudinal slot is defined in the first housing and is served to slidably fix the push switch so that the push switch is rotatably connected with the movable member, and when the movable member is located at the second position, the press switch drives the movable member to move along the longitudinal slot.

12. The strap wrench as claimed in claim 10, wherein the second housing has a circular trough and an arcuate trough, the supporting block is coupled with the second housing by inserting a first bolt into the circular trough through the supporting block and by inserting a second bolt into the arcuate trough via the supporting block, such that the supporting block swings along the first bolt limitedly.

13. The strap wrench as claimed in claim 10, wherein the guiding rod includes a toothed section arranged therearound, and the press switch has plural engagement teeth engaging with the toothed section of the guiding rod, such that the movable member is located at the second position.

14. A strap wrench being used to drive a cylindrical object and comprising:

a handle being hollow and including at least two recesses, a longitudinal slot, and a first housing and a second housing which are locked together, the two recesses being obliquely formed on one end of an inner wall of the second housing;

a strap made of metal material and including a first end portion and a second end portion which are inserted into the two recesses of the handle to wind a cylindrical object;

a guiding rod longitudinally inserted into the handle;

a supporting block rotatably connected with a first segment of the handle and located inside the strap and employed to support the cylindrical object;

a movable member disposed on the guiding rod and moving between a first position and a second position, the movable member including a through groove for inserting the guiding rod, the movable member joining with the first end portion and the second end portion of the strap, wherein when the movable member is located at the first position, the strap is loosened relative to the cylindrical object, and when the movable member is located at the second position, the strap is tightened relative to the cylindrical object;

a push switch slidably fixed in the longitudinal slot and rotatably connected with the movable member, wherein the push switch is engaged with or disengaged from the guiding rod so that the movable member moves between the first position and the second position;

a spring for pushing the movable member to move toward the second position; and a fixing member fixed between the first housing and the second housing for inserting the guiding rod;

wherein between the two recesses is defined a retaining opening for retaining a connecting member, and the guiding rod is coupled with the connecting member; and wherein the through groove has a stopping fence formed on an inner side thereof, the spring includes a first end abutting against the stopping fence and a second end for pushing against the connecting member.

15. The strap wrench as claimed in claim 14, wherein the spring is fitted on a circular column, and the circular column includes a first end disposed in the connecting member and a second end secured in the fixing member via the through groove.

16. The strap wrench as claimed in claim 14, wherein the longitudinal slot is defined in the first housing and is served to slidably fix the push switch so that the push switch is rotatably connected with the movable member, and when the movable member is located at the second position, the press switch drives the movable member to move along the longitudinal slot.

17. The strap wrench as claimed in claim 14, wherein the second housing has a circular trough and an arcuate trough, the supporting block is coupled with the second housing by inserting a first bolt into the circular trough through the supporting block and by inserting a second bolt into the arcuate trough via the supporting block, such that the supporting block swings along the first bolt limitedly.

18. The strap wrench as claimed in claim 14, wherein the guiding rod includes a toothed section arranged therearound, and the press switch has plural engagement teeth engaging with the toothed section of the guiding rod, such that the movable member is located at the second position.

* * * * *